US011229345B2

(12) United States Patent
Pugh et al.

(10) Patent No.: US 11,229,345 B2
(45) **Date of Patent: *Jan. 25, 2022**

(54) DISHWASHER GLASSWARE BUMPER

(71) Applicant: WHIRLPOOL CORPORATION, Benton Harbor, MI (US)

(72) Inventors: Jonathan D. Pugh, Benton Harbor, MI (US); Ameresh B. Viswanathan, St. Joseph, MI (US); Michael Kahwaji, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 29 days.

This patent is subject to a terminal disclaimer.

(21) Appl. No.: 16/830,781

(22) Filed: Mar. 26, 2020

(65) Prior Publication Data

US 2020/0221925 A1 Jul. 16, 2020

Related U.S. Application Data

(63) Continuation of application No. 15/841,425, filed on Dec. 14, 2017, now Pat. No. 10,638,914.

(51) Int. Cl.
*A47L 15/50* (2006.01)
*A47L 15/00* (2006.01)

(52) U.S. Cl.
CPC ..... *A47L 15/505* (2013.01); *A47L 15/0065* (2013.01)

(58) Field of Classification Search
CPC ..... A47L 15/505; A47L 15/0065
See application file for complete search history.

(56) References Cited

U.S. PATENT DOCUMENTS

| | | | | |
|---|---|---|---|---|
| 10,638,914 | B2 * | 5/2020 | Pugh | A47L 15/505 |
| 2005/0016941 | A1 | 1/2005 | Neff et al. | |
| 2005/0236345 | A1 | 10/2005 | Herbst et al. | |
| 2006/0138064 | A1 | 6/2006 | Crudgington, Jr. | |
| 2006/0213844 | A1 | 9/2006 | Purushothaman | |
| 2006/0289038 | A1 | 12/2006 | Hedstrom et al. | |
| 2007/0056919 | A1 | 3/2007 | Moore | |
| 2008/0308510 | A1 | 12/2008 | Richardson | |
| 2009/0050585 | A1 | 2/2009 | Lindgren et al. | |
| 2009/0065455 | A1 | 3/2009 | Miller et al. | |
| 2012/0292273 | A1 | 11/2012 | McNamara | |
| 2012/0298155 | A1 | 11/2012 | Blanchard et al. | |
| 2015/0164301 | A1 | 6/2015 | Bartloff et al. | |
| 2017/0258294 | A1 | 9/2017 | Mesa et al. | |

FOREIGN PATENT DOCUMENTS

WO 2015000507 A1 1/2015

* cited by examiner

*Primary Examiner* — Benjamin L Osterhout
(74) *Attorney, Agent, or Firm* — McGarry Bair PC

(57) ABSTRACT

A dishwasher including a dish rack having a wire frame rack defining an interior and comprising a plurality of spaced wire frame elements defining a dish supporting surface forming at least a portion of the interior, and a bumper having a body and an elastic surface. The bumper can span at least two of the wire frame elements.

20 Claims, 6 Drawing Sheets

DISHWASHER GLASSWARE BUMPER

CROSS REFERENCE TO RELATED APPLICATIONS

This application is a continuation of U.S. patent application Ser. No. 15/841,425, filed Dec. 14, 2017, now U.S. Pat. No. 10,638,914, all of which is hereby incorporated by reference in its entirety.

BACKGROUND OF THE INVENTION

Contemporary automatic dishwashers for use in a typical household include a tub defining a treating chamber and a spraying system for recirculating liquid throughout the tub to remove soils from dishes and utensils. Upper and lower dish racks for holding dishes to be cleaned are typically provided within the treating chamber. Often times a dish, such as glassware doesn't fit in an ideal position on the dish rack, which can lead to clanging of the glassware against other dishes or the dish rack itself, especially in response to being hit by the liquid spray.

BRIEF DESCRIPTION OF THE INVENTION

In one aspect, the present disclosure relates a dish rack for an automatic dishwasher, the dish rack comprising: a wire frame rack comprising a plurality of spaced wire frame elements forming a bottom wall and a peripheral wall, which circumscribes the bottom wall to define an interior, and the bottom wall defining a dish supporting surface; and a bumper having a body spanning at least two of the wire frame elements forming the bottom wall, an elastic element provided on the body and facing the interior, and a clip slidable coupling the body to at least some of the spaced wire frame elements.

In another aspect, the present disclosure relates to a dish rack assembly for an automatic dishwasher, the dish rack assembly comprising: a wire frame rack comprising a plurality of spaced, coated wire frame elements forming a bottom wall and a peripheral wall, which circumscribes the bottom wall to define an interior, and the bottom wall defining a dish supporting surface; a bumper having a rigid body spanning at least some of the wire frame elements and a rubber element supported on the rigid body and having a static coefficient of friction greater than the coated wire frame elements; and at least one clip slidably mounting the bumper to at least one of the wire frame elements forming the bottom wall.

DESCRIPTION OF EMBODIMENTS OF THE INVENTION

Figure 1:
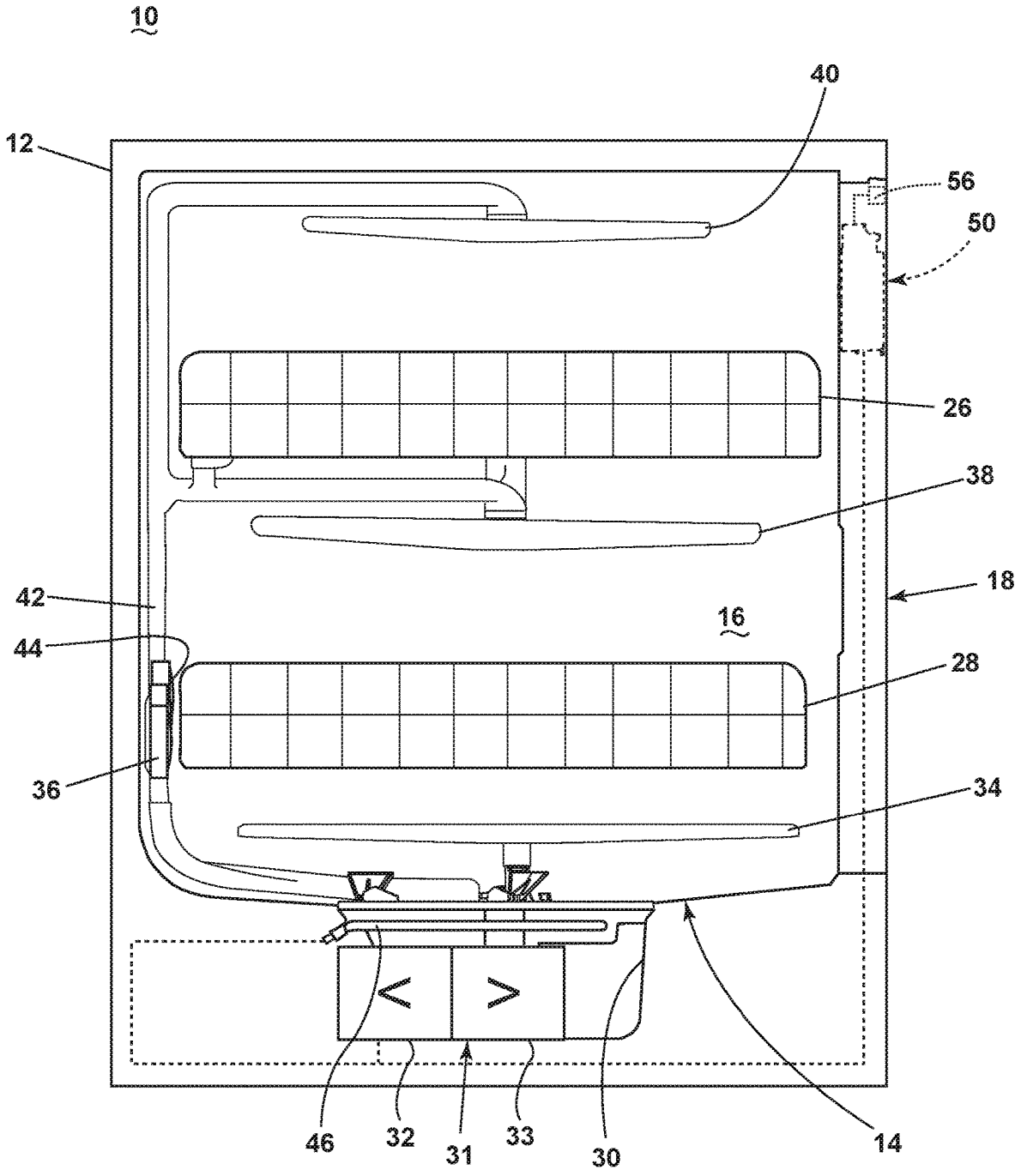
FIG. 1 is a schematic, cross-sectional view of a dishwasher according to an aspect of the present disclosure.

In FIG. 1, an automated dishwasher 10 according to aspects of the present disclosure is illustrated. The dishwasher 10 shares many features of a conventional automated dishwasher, which will not be described in detail herein except as necessary for a complete understanding. A chassis 12 can define an interior of the dishwasher 10, including a space below the tub 14 and can include a frame, with or without panels mounted to the frame. An open-faced tub 14 can be provided within the chassis 12 and can at least partially define a treating chamber 16, having an open face, for washing dishes. A door assembly 18 can be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open.

A dish rack assembly, illustrated in the form of upper and lower dish racks 26, 28, is located within the treating chamber 16 and receives dishes for washing. The upper and lower racks 26, 28 are typically mounted for slidable movement in and out of the treating chamber 16 for ease of loading and unloading. The upper and lower dish racks 26, 28 can be in the form of a wire frame rack. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware. While the dishwasher 10 is shown with two dish racks, any number of dish racks can be included.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system can include a sump 30 and a pump assembly 31. The sump 30 collects the liquid sprayed in the treating chamber 16 and can be formed by a sloped or recess portion of a bottom wall of the tub 14. The pump assembly 31 can include both a drain pump 32 and a recirculation pump 33. The drain pump 32 can draw liquid from the sump 30 and pump the liquid out of the dishwasher 10 to a household drain line (not shown). The recirculation pump 33 can draw liquid from the sump 30 and the liquid can be simultaneously or selectively pumped through a supply tube 42 to each of the assemblies 34, 36, 38, 40 for selective spraying. While not shown, a liquid supply system can include a water supply conduit coupled with a household water supply for supplying water to the treating chamber 16.

A heating system including a heater 46 can be located within the sump 30 for heating the liquid contained in the sump 30.

A controller 50 can also be included in the dishwasher 10, which can be operably coupled with various components of the dishwasher 10 to implement a cycle of operation. The controller 50 can be located within the door 18 as illustrated, or it can alternatively be located somewhere within the chassis 12. The controller 50 can also be operably coupled with a control panel or user interface 56 for receiving user-selected inputs and communicating information to the user. The user interface 56 can include operational controls such as dials, lights, switches, and displays enabling a user to input commands, such as a cycle of operation, to the controller 50 and receive information.

Figure 2:
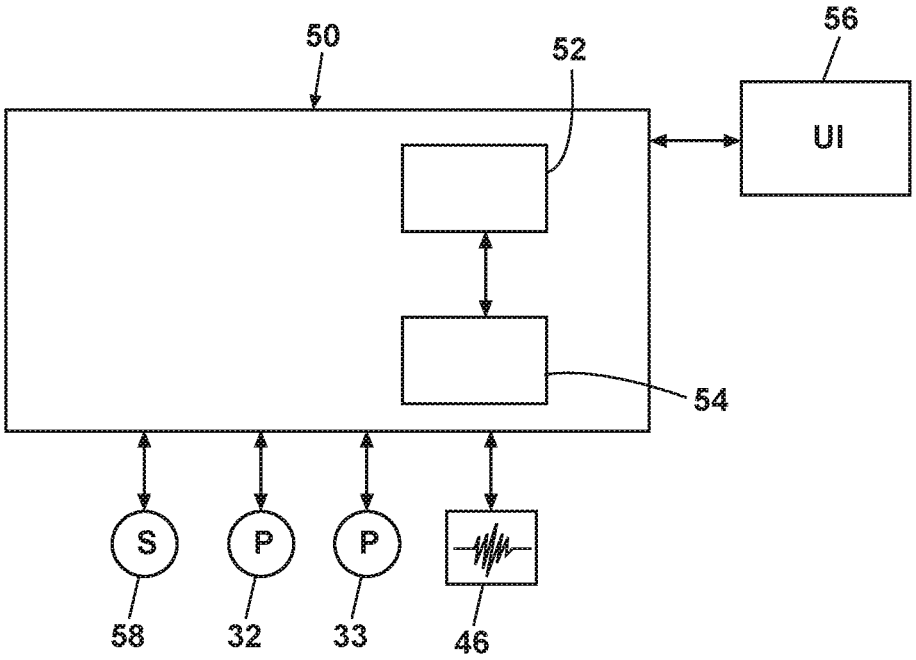
FIG. 2 is a schematic view of a controller of the dishwasher of FIG. 1.

As illustrated schematically in FIG. 2, the controller 50 can be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 can be provided with a memory 52 and a central processing unit (CPU) 54. The memory 52 can be used for storing control software that can be executed by the CPU 54 in completing a cycle of operation using the dishwasher 10 and any additional software. For example, the memory 52 can store one or more pre-programmed cycles of operation that can be selected by a user and completed by the dishwasher 10. The controller 50 can also receive input from one or more sensors 58. Non-limiting examples of sensors that can be communicably coupled with the controller 50 include a temperature sensor and turbidity sensor to determine the soil load associated with a selected grouping of dishes, such as the dishes associated with a particular area of the treating chamber.

Figure 3A:
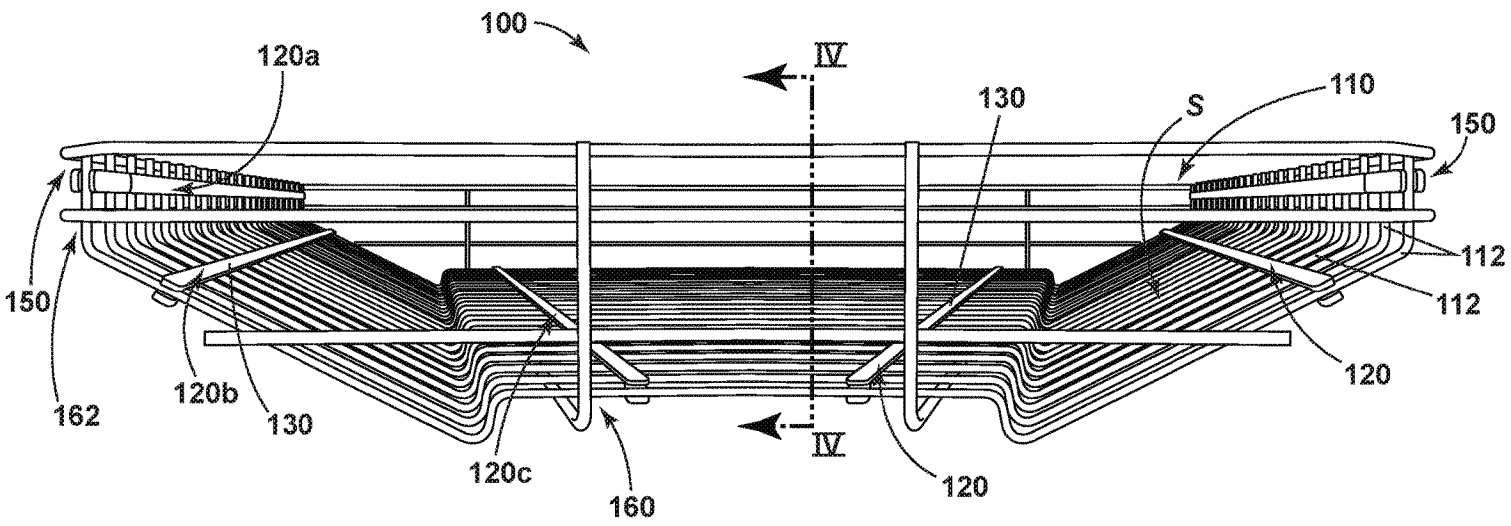
FIG. 3A is a perspective view of a wire frame rack according to aspects of the present disclosure.

FIG. 3A illustrates a perspective view of a dish rack according to aspects of the present disclosure in the form of a wire frame rack 100. The wire frame rack 100 includes a plurality of spaced wire frame elements 112, or wires, and bumpers 120 carried by the wire frame elements 112. The wire frame elements 112 define a dish supporting surface S that forms at least a portion of an interior 110 for the wire frame rack 100. At least a portion of a bottom wall 160 or a peripheral side wall 162 can also define the supporting surface S which can further define the interior 110. The wire frame 112 elements can be provided with a coating to cushion and protect the dishes. The coating can be a plastic coating, but is not limited to such. A body 130 of the bumper 120 can span at least two of the wire frame elements 112. Bumpers 120*a* and 120*b* are illustrated as spanning along the side wall 162, while bumper 120*c* is illustrated as spanning along the bottom wall 160.

Figure 3B:
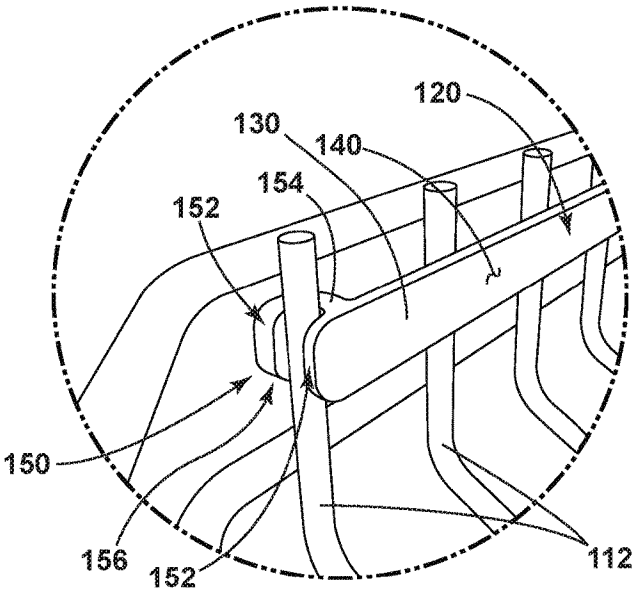
FIG. 3B is an enlarged portion of the wire frame rack in FIG. 3A.

Aspects of the bumper 120 can be more clearly seen in the enlarged portion of FIG. 3. The body 130 of the bumper 120 can be constructed of a rigid material and include a frictional, or elastic surface 140, supported by the rigid material, that can confront the interior 110 of the wire frame rack 100. The elastic surface 140 can have a static coefficient of friction greater than the coating on the wire frame elements 112 to help prevent relative motion between the elastic surface 140 and the wire frame elements 112. An example of a material for the elastic surface 140 can be a suitable rubber, such as a thermoplastic vulcanized rubber, but it not limited to a rubber and can be any material with a sufficient static coefficient of friction.

The body 130 can further include at least one clip 150 coupled to at least one of the wire frame elements 112 in order to repositionably mount the bumper 120 to the wire frame element 112. While only one clip 150 is shown at one end of the bumper 120, it is possible for one end of the bumper 120 to include multiple, spaced clips 150 in order to accommodate various heights of bumpers 120. The clip 150 can be in the form of a U-shaped clip having two fingers 152 connected by a bight portion 154, which define a slot 156 that receives the wire frame element 112. At least one of the two fingers 152 is resilient such that it can be more flexible than the other of the two fingers 152 in order to deflect, or bend, as the wire frame element 112 is received in the slot 156. To couple the clip 150 to the body 130, the clip can be mounted to the body 130, such as by adhesive, or it can be integrally formed with the body 130, such as by molding the clip 150 as part of the body 130.

Figure 4:
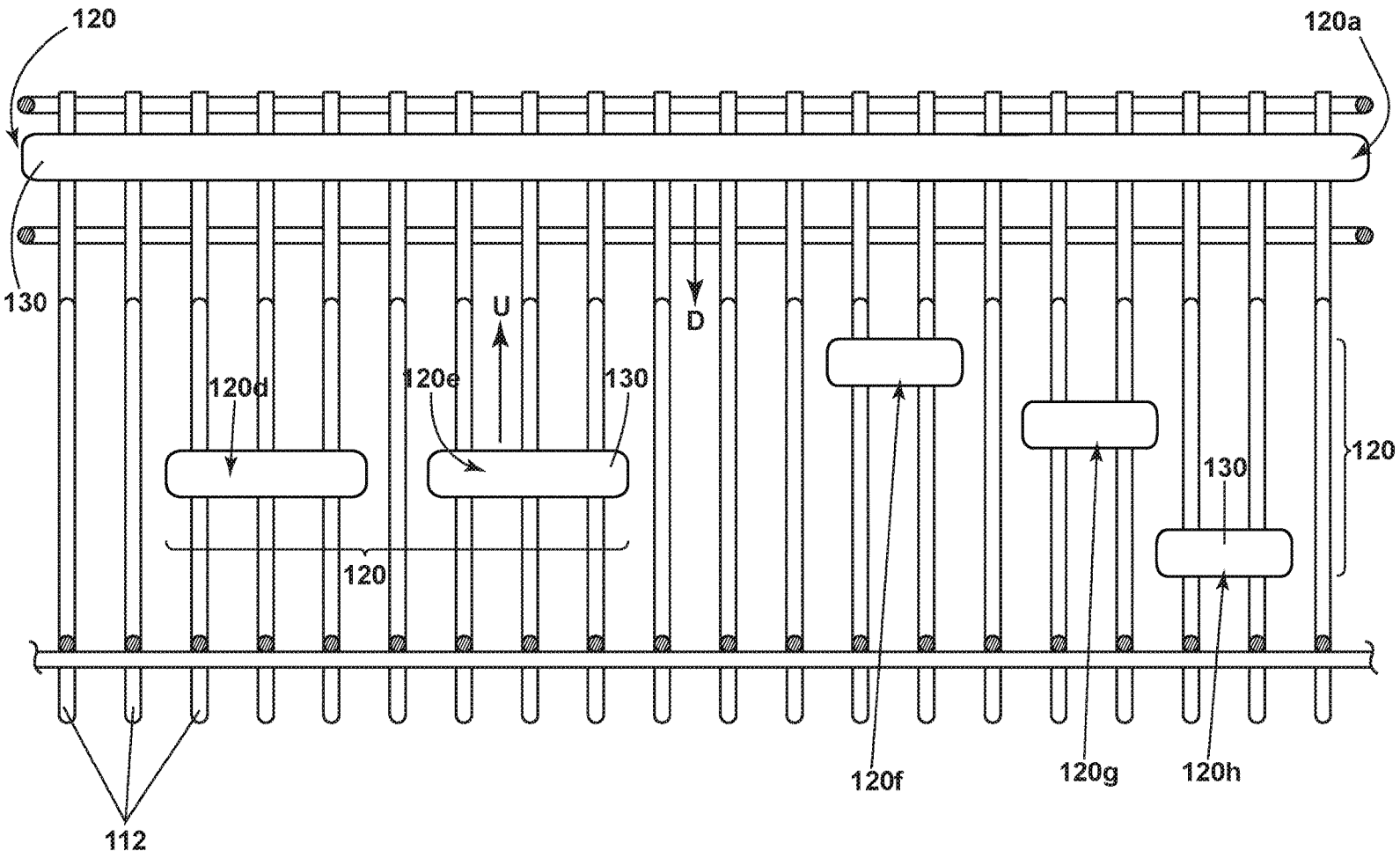
FIG. 4 is a side view of the wire frame rack of FIG. 3 along line IV-IV with different bumpers according to various aspects of the present disclosure.

The clip 150 can permit the bumper 120 to be repositionable along the wire frame elements 112, as illustrated in FIG. 4. FIG. 4 is a side view of the wire frame rack 100 of FIG. 3 along line IV-IV with additional bumpers 120. The bumper 120 can include a continuous segment spanning more two or more wire frame elements 112 as illustrated by segment 120*a*. The bumper 120 can also include multiple discrete segments, each of which spans at least two wire frame elements 112, as illustrated by segments 120*d* and 120*e*. As the bumpers 120 are repositionable, at least some of the multiple discrete segments can be offset relative to each other, as illustrated by the laterally offset segments 120*f*, 120*g*, and 120*h*. The bumpers 120 can easily be moved upwards or downwards as indicated by arrows U and D. The bumpers 120 can be of different lengths, even of a sufficient length that a single bumper 120 spans all of the wire frame elements 112 on one wall.

Figure 5:
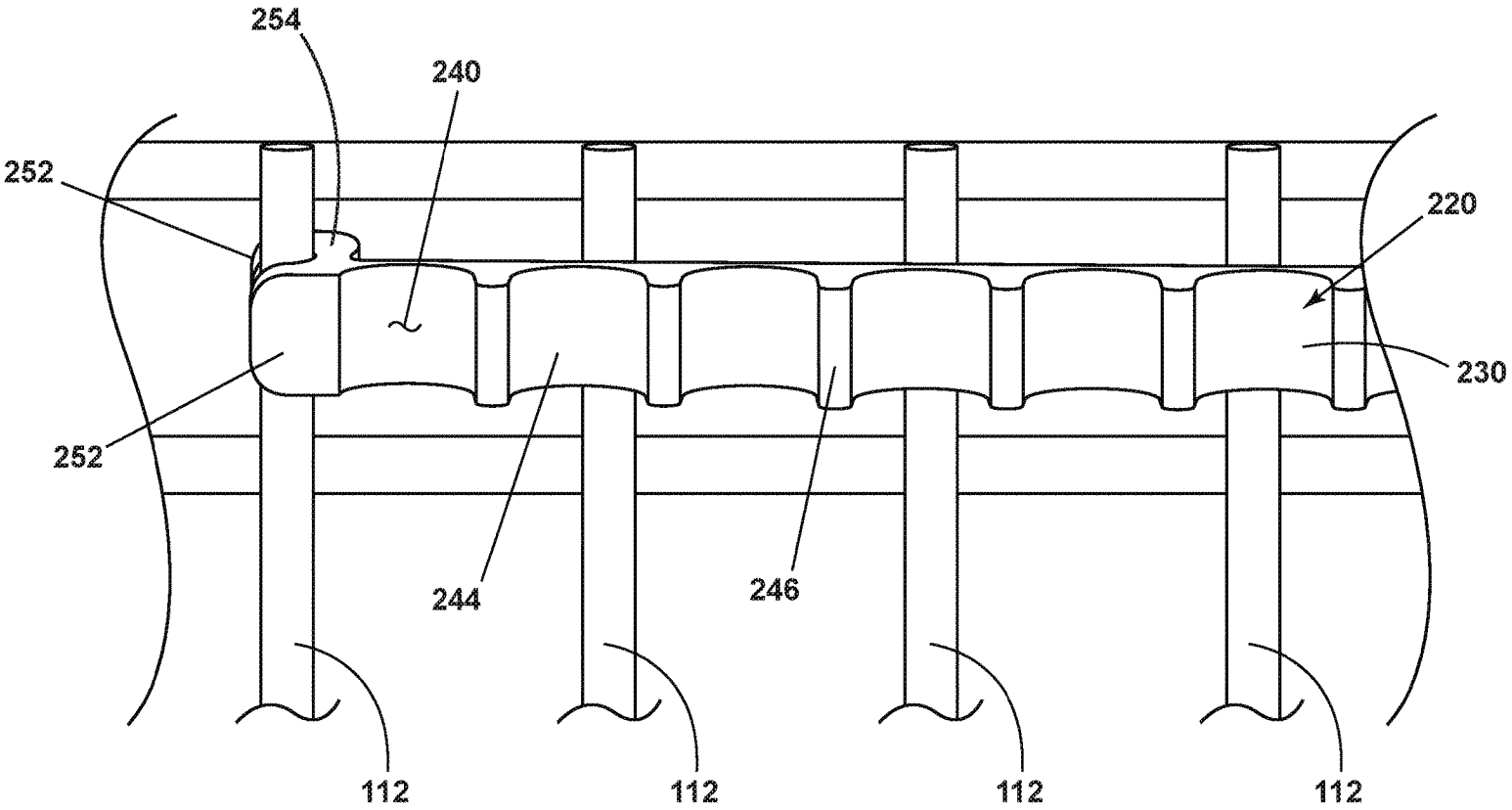
FIG. 5 is an enlarged view of a bumper according to another aspect of the present disclosure.

Turning to FIG. 5, an enlarged view of the wire frame rack 100 having a bumper 220 according to a second embodiment of the disclosure. The second embodiment is similar to the first embodiment; therefore, like parts will be identified with like numerals increased by 100, with it being understood that the description of the like parts of the first embodiment applies to the second embodiment, unless otherwise noted.

While the first embodiment, bumper 120 in FIGS. 3-4 includes a smooth elastic surface 140, the bumper 220 in the second embodiment includes an elastic surface 240 having a profile with repeating, or a series of peaks 246 and valleys 244. Although FIG. 5 illustrates the bumper 220 having repeating peaks 246 and valleys 244, it is possible for the bumper 220 to include only one peak 246 or valley 244. The frequency of the peaks 246 and valleys 244 can vary such that the distance between each peak 246 or valley 244 can be longer or shorter, depending on the desired need for the dishes. For example, the distance between the peaks can be equal to the anticipated spacing of the cup or container to be received within the valley or to the spacing of a stem of glassware. The height of the peaks 246 can also vary depending on the desired need for the dishes. A valley 244 can be used to rest a stem of glassware, while the peaks 246 can retain the stem within the valley 244. The valley 244 can also have a profile that conforms to an anticipated profile of the shape of the dish, such as a cup, to be received within the valley 244.

Figure 6:
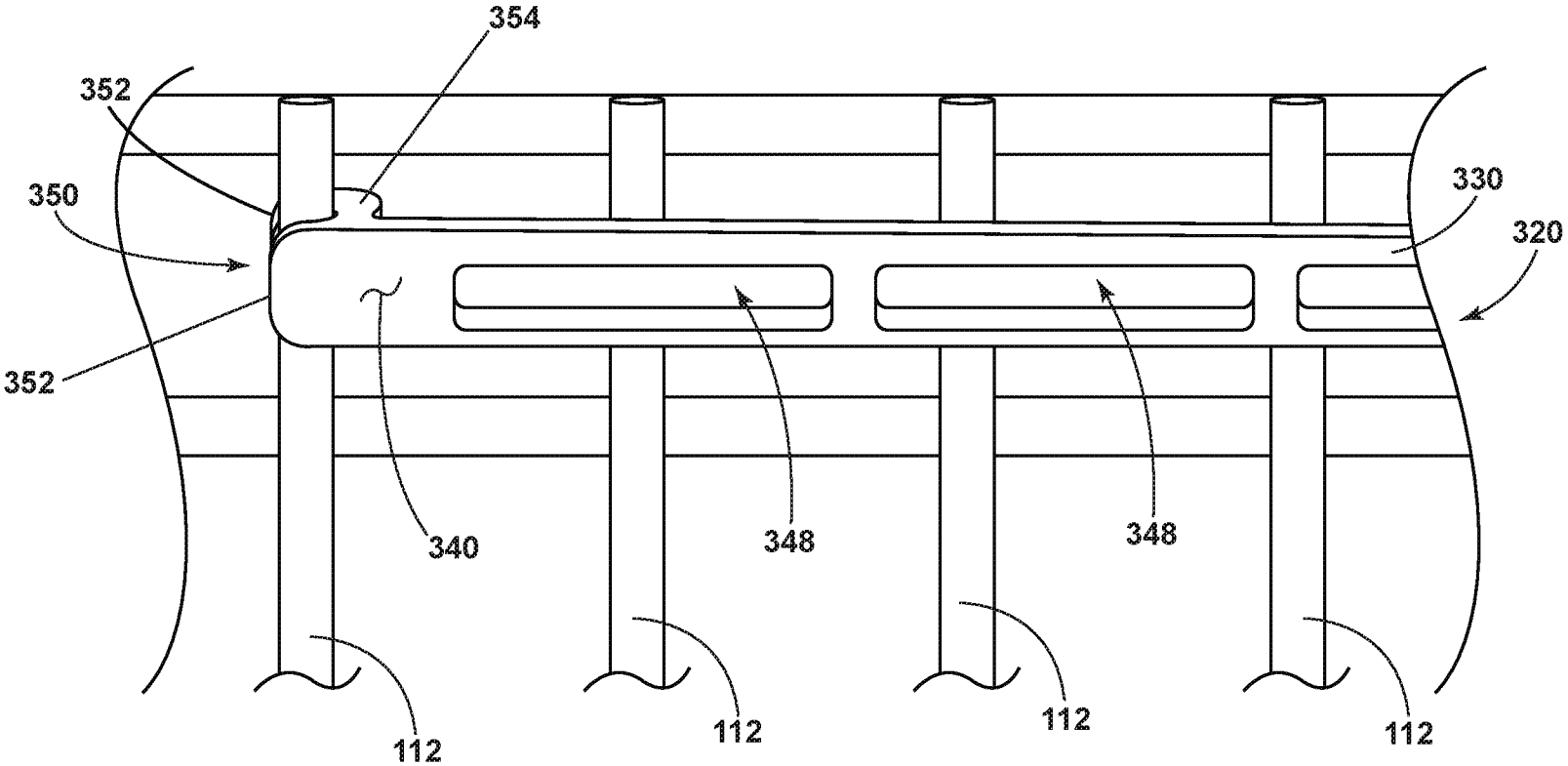
FIG. 6 is an enlarged view of a bumper according to yet another aspect of the present disclosure.

Turning to FIG. 6, an enlarged view of the wire frame rack 100 having a bumper 320 according to a third embodiment of the disclosure. The third embodiment is similar to the first embodiment; therefore, like parts will be identified with like numerals increased by 200, with it being understood that the description of the like parts of the first embodiment applies to the third embodiment, unless otherwise noted.

The bumper 320 in the third embodiment includes body 330 and elastic surface 340 having apertures 348. The apertures 348 can vary in width, height and frequency, depending on the desired need for the dishes. Although FIG. 6 illustrates the bumper 320 having periodic apertures 348, it is possible for the bumper 320 to have only one aperture 348, or apertures 348 that are not periodic, or at fixed intervals, such that the distance between apertures 348 can vary relative to each aperture 348. Providing apertures 348 on the bumper 320 can allow for wash water to flow through the bumper 320, which can be advantageous for washing the dishes.

The aspects of the disclosure described herein can be used to provide additional cushioning for dishes, such as glassware, and to prevent dishes from clanging during an automatic cycle of operation in a dishwasher, ensuring that the dishes are protected. Aspects of the disclosure can be used to avoid the undesirable circumstances when dishes are damaged due to clanging of the dishes or when the force on the dishes against the wire frame elements is too strong. For example, it is ideal for the stem of glassware to rest on the dish rack rather than the rim of the glassware. Aspects of the disclosure allow for adjusting the resting points of dishes to provide ideal resting points, thus avoiding possible damage to the dishes. It will be understood that while the aspects of the disclosure described herein are shown in the context of a dishwasher, the aspects of the disclosure can be utilized to provide cushioning for components of any household appliance.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. For example, it is possible for the bumper 120 to include peaks 246, valleys 244, or apertures 348 so that the body 130 of bumper 120 includes a combination of profiles.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

The invention claimed is:

1. A dish rack for an automatic dishwasher, the dish rack comprising:

a wire frame rack comprising a plurality of spaced wire frame elements forming a bottom wall and a peripheral wall, which circumscribes the bottom wall to define an interior, and the bottom wall defining a dish supporting surface; and a bumper having a body spanning at least two of the wire frame elements forming the bottom wall, an elastic element provided on the body and facing the interior, and a clip slidably coupling the body to at least some of the spaced wire frame elements.

2. The dish rack of claim 1 wherein the body comprises a continuous segment spanning more than two wire frame elements.

3. The dish rack of claim 1 wherein the bumper comprises multiple bumpers, each of which spans at least two wire frame elements.

4. The dish rack of claim 3 wherein at least some of the multiple bumpers are offset relative to each other.

5. The dish rack of claim 1 wherein the bottom wall comprises a horizontal portion and an angled portion, which is oriented at an angle relative to the horizontal portion, and the bumper is located on the angled portion.

6. The dish rack of claim 5 wherein the angled portion extend upwardly from the horizontal portion.

7. The dish rack of claim 6 wherein the angled portion terminates at the peripheral wall.

8. The dish rack of claim 1 wherein the clip comprises at least one resilient finger, which deflects to secure the clip to one of the spaced wire frame elements.

9. The dish rack of claim 1 wherein the at least one clip comprises multiple, spaced clips.

10. The dish rack of claim 1 wherein the elastic element is a rubber element.

11. The dish rack of claim 10 wherein the wire frame elements are coated and the static coefficient of friction of the rubber element is greater than the static coefficient of friction of the coating.

12. The dish rack of claim 10 wherein the body comprises a rigid material supporting the elastic element.

13. The dish rack of claim 1 wherein the elastic element has a profile with at least one valley.

14. The dish rack of claim 13 wherein the elastic element has a profile with a least one peak.

15. The dish rack of claim 14 wherein the elastic element has a profile of repeating peaks and valleys.

16. A dish rack assembly for an automatic dishwasher, the dish rack assembly comprising:

a wire frame rack comprising a plurality of spaced, coated wire frame elements forming a bottom wall and a peripheral wall, which circumscribes the bottom wall to define an interior, and the bottom wall defining a dish supporting surface;

a bumper having a rigid body spanning at least some of the wire frame elements and a rubber element supported on the rigid body and having a static coefficient of friction greater than the coated wire frame elements; and at least one clip slidably mounting the bumper to at least one of the wire frame elements forming the bottom wall.

17. The dish rack assembly of claim 16 wherein the bottom wall comprises a horizontal portion and an angled portion, which is oriented at an angle relative to the horizontal portion, and the bumper is located on the angled portion.

18. The dish rack assembly of claim 17 wherein the angled portion extend upwardly from the horizontal portion.

19. The dish rack assembly of claim 18 wherein the angled portion terminates at the peripheral wall.

20. The dish rack assembly of claim 19 wherein the bumper comprises multiple segments, with at least some of the multiple segments being laterally offset relative to each other.

* * * * *